US008544991B2

(12) United States Patent
Gray et al.

(10) Patent No.: US 8,544,991 B2
(45) Date of Patent: Oct. 1, 2013

(54) CONSUMABLE SUPPLY ITEM, FLUID RESERVOIR AND RECIRCULATION SYSTEM FOR MICRO-FLUID APPLICATIONS

(75) Inventors: Trevor Gray, Versailles, KY (US); Charles Aldrich, Nicholasville, KY (US); Jason Vanderpool, Lexington, KY (US); Robert Muyskens, Lexington, KY (US); Gregory Webb, Lexington, KY (US); David Ward, Lexington, KY (US)

(73) Assignee: Funai Electric Co., Ltd. (JP)

( * ) Notice: Subject to any disclaimer, the term of this patent is extended or adjusted under 35 U.S.C. 154(b) by 96 days.

(21) Appl. No.: 12/980,556

(22) Filed: Dec. 29, 2010

(65) Prior Publication Data

US 2012/0169812 A1 Jul. 5, 2012

(51) Int. Cl.
*B41J 2/175* (2006.01)

(52) U.S. Cl.
USPC ..... 347/85; 101/335; 101/366; 347/17; 347/50; 347/70; 347/86; 347/89

(58) Field of Classification Search
None
See application file for complete search history.

(56) References Cited

U.S. PATENT DOCUMENTS

| | | | | |
|---|---|---|---|---|
| 3,929,071 | A | 12/1975 | Cialone | |
| 4,023,182 | A | 5/1977 | Arway | |
| 4,320,407 | A | 3/1982 | Goldis | |
| 4,607,261 | A | 8/1986 | McCann | |
| 4,614,948 | A | 9/1986 | Katerberg | |
| 4,775,871 | A | 10/1988 | Abe | |
| 4,809,015 | A | 2/1989 | Bowling | |
| 5,915,302 | A | 6/1999 | Baba | |
| 6,116,727 | A | 9/2000 | Hagiwara | |
| 6,217,164 | B1 | 4/2001 | Hino | |
| 6,283,585 | B1 | 9/2001 | Ikkatai | |
| 6,312,113 | B1 | 11/2001 | Murad | |
| 6,443,560 | B1 | 9/2002 | Okano | |
| 7,040,745 | B2 | 5/2006 | Kent | |
| 7,566,121 | B2 | 7/2009 | Ohishi | |
| 8,091,995 | B2 * | 1/2012 | Shimizu et al. | 347/86 |
| 2001/0020971 | A1 * | 9/2001 | Usui et al. | 347/86 |
| 2002/0196312 | A1 * | 12/2002 | Ishizawa et al. | 347/50 |
| 2004/0085416 | A1 | 5/2004 | Kent | |
| 2005/0168540 | A1 * | 8/2005 | Wilson et al. | 347/85 |
| 2006/0066698 | A1 | 3/2006 | Takatsuka | |

FOREIGN PATENT DOCUMENTS

| | | | |
|---|---|---|---|
| EP | 1518692 | A1 | 3/2005 |
| WO | 2009049146 | A1 | 4/2009 |

* cited by examiner

*Primary Examiner* — Matthew Luu
*Assistant Examiner* — John P Zimmermann
(74) *Attorney, Agent, or Firm* — Amster, Rothstein & Ebenstein LLP

(57) ABSTRACT

A consumable supply item for an imaging device holds an initial or refillable volume of ink. An interior retains the ink while exit and return ports define openings through a housing to fluidly communicate the interior to the imaging device. The opening of the return port is larger than the opening of the exit port. The design slows the return of fluid to the housing which minimizes air bubbles or frothiness in the fluid. During use, ink depletes toward a bottom surface of the interior beneath which the ink is prevented from occupying. A housing section below the interior retains a portion of the exit port so that a bottom of the opening of the exit port is substantially horizontally aligned with the bottom surface. It prevents stranding ink beneath the exit port. Further embodiments include port configuration, construction, and modular components, to name a few.

20 Claims, 5 Drawing Sheets

40
Air Vent
Ink return
Ink outlet
Combined return/outlet

CONSUMABLE SUPPLY ITEM, FLUID RESERVOIR AND RECIRCULATION SYSTEM FOR MICRO-FLUID APPLICATIONS

FIELD OF THE INVENTION

The present invention relates to micro-fluid applications, such as inkjet printing. More particularly, although not exclusively, the invention relates to fluid recirculation throughout an imaging device. Consumable supply items and fluid reservoirs facilitate certain designs.

BACKGROUND OF THE INVENTION

The art of printing images with micro-fluid technology is relatively well known. A disposable or (semi)permanent ejection head has access to a local or remote supply of fluid (e.g., ink). The fluid ejects from an ejection zone to a print media in a pattern of pixels corresponding to images being printed.

To ready the head for use, manufacturers prime the disposable cartridges at the factory before shipment. (Semi)Permanent heads, on the other hand, become primed at the time of use inside an imaging device. A vacuum draws fluid from the supply item and delivers it to individual nozzles of the head. As the operation nears completion, excess fluid spills from the nozzles. The amount of fluid wasted corresponds proportionately to the number of nozzles.

After establishing the prime, systems exist to maintain backpressure throughout the imaging device. In low cost systems, or those with low page output, backpressure is commonly controlled by inserting directly into the fluid supply a foam sponge, felt piece, expandable lung, or other similar device. In more expensive systems, and those with higher page output, backpressure is routinely kept by fixing a height of the ejection head relative to a volume of fluid in the supply. As the volume varies, the height of the supply requires adjustment upward or downward. As this is often impractical, or imprecise, the backpressure is allowed to vary over the lifetime of the supply. Variable pressure, however, can detrimentally affect imaging performance.

A page wide imaging device only exacerbates the foregoing problems. As a page wide device has nozzles spanning an entire width of a print media, the amount of fluid wasted during priming operations is significantly greater than scanning style heads having shorter lengths spanning only about an inch in length, or less. The volume requirements in supply items for page wide devices are also usually greater than those for a scanning head. As taller supply tanks are the norm, the backpressure in page wide devices varies more greatly which leads to performance challenges.

Fluid flow from supply items to ejection heads can occur either with gravity feeding or pumping systems. Each has its own unique set of problems. Gravity feeding necessitates elevated positioning of supply items in an imaging device thereby increasing the size of the devices and limiting positions of supply item placement. Air locks in fluid tubing and elsewhere are also prevalent which causes imaging failure for want of sufficient amounts of fluid. Pumping systems, on the other hand, increase design complexity as dedicated pumps are required one each per the many colors of fluids channeled throughout an imaging device. Alternatively, complex clutching is necessary if but a single pump is used per the many color channels. Both gravity feed and pumping systems require significant sensors and controls to uniquely monitor and regulate their style of fluid flow. Gravity systems need floats and valves, or the like. Pumping systems need pressure monitoring and feedback devices, to name a few.

The supply item typically contains dye or pigment based ink. Dye ink is typically cheap and has broad color coverage. Pigmented ink is generally more expensive, but has a longer archival print life and higher color stability. Pigmented ink, unfortunately, is also known to settle downward over time leaving rich concentrations near a bottom of a container and leaner concentrations near a top. When printing, ink drawn from the bottom leads first to excessively densely printed colors and later to excessively lightly printed colors. The variations often result in unacceptable visible defects. The former also has the potential to clog ejection head nozzles as large particles accumulate together in micron-sized channels having fastidious fluid flow standards.

To overcome settling problems, the prior art has introduced mechanical stir bars and other agitating members that roil ink and mix sediments before and during use. While nominally effective, the approach causes expensive/complex manufacturing and necessitates motive force during use to set agitating bodies into motion. The art also has fluid exit ports raised to heights measurably higher than the floor of the container. While this avoids supplying ink to an imaging device having too dense a concentration, it prevents full use of a container's contents as appreciable amounts of ink rest below the exit port on the lowermost surfaces of the container. Still other designs contemplate both agitating members and raised exit ports. This only compounds the noted problems.

Accordingly, a need exists in the art to improve fluid control in imaging devices, especially lengthy devices spanning page widths or larger. The need extends not only to better controlling backpressure, but to eliminating wasteful practices. Avoiding artificial constraints in size, spacing and positioning of fluid structures are still further recognized needs as is eliminating complexity of design. Supplying to an imaging device an entirety of ink in a container is a concomitant need as is delivering ink with uniform concentration over a lifetime of the container. Additional benefits and alternatives are also sought when devising solutions.

SUMMARY OF THE INVENTION

The above-mentioned and other problems become solved with consumable supply items and intermediate reservoirs in a fluid recirculation system of an imaging device.

A consumable supply item for the imaging device holds an initial or refillable volume of ink. Its housing defines an interior and exterior. The interior retains the ink while ink exit and return ports defining openings through the housing to fluidly communicate the interior to and from the imaging device. The opening of the ink return port is greater in size than the opening of the ink exit port. The design slows the return of fluid to the housing to minimize air bubbles or frothiness in the fluid.

During use, the housing is oriented to deplete the volume of ink in a direction of gravity toward a bottom surface of the interior beneath which the volume of ink is prevented from occupying. A housing section below the interior retains a portion of the exit port so that a bottom of the opening of the exit port is substantially horizontally aligned with the bottom surface. It allows the passage of an entirety of the volume of ink from the interior to the imaging device without stranding the volume of ink beneath the opening of the ink exit port. Modular components, arrangement of the ports on the housing, preferential port sizes, air venting, and port plugging arrangements to prevent fluid leakage define other embodiments, to name a few.

In an imaging device, multiple different supply items exist for many colors of fluid (e.g., cyan, magenta, yellow and black). Multiple channels circulate colored fluid between supply item containers and nozzles of an ejection head. A single pump, however, maintains the entirety of fluid flowing in the imaging device. It does so also without complex control systems, clutches, feedback sensors or other similar control mechanisms. As ink recycles back to the housing, action of the pump stirs the fluid in the container. Sediments in pigmented based ink are mixed thoroughly. The design overcomes settling during periods of inactivity. It improves conventional designs having mechanical stir bars and other mechanisms. It limits entrainment of particles settled at the bottom of the container.

A fluid reservoir is intermediately disposed between the supply item and the ejection head. The reservoir sets the backpressure for each of the color channels in the imaging device. It also temporarily stores overflowed fluid awaiting transport back to the supply container.

In detail, each reservoir has a first inlet and outlet connected to a respectively colored supply item. A second inlet and outlet connects to the ejection head. The reservoir has two sections: a backpressure region that connects threefold to each of the first inlet from the supply container and the second inlet and outlets communicated to the ejection head; and an overflow region that connects only to the ink return port of the supply item. A wall divides the two sections in the reservoir. As ink flows into the reservoir from the supply item, it fills the backpressure region. Eventually, fluid rises higher than the height of the dividing wall and spills into the overflow region. The operation is similar to a dam. It avoids the use of floats or valves. Once in the overflow region, the spilled-over fluid can return to the ink supply on demand. As four fluid channels operate upon the action of a single pump, fluid in respective reservoirs can sit at various heights. During use, less full reservoirs can fill as the pump operates, while full reservoirs can simultaneously return fluid back to their supply containers. Fluid does not spill from the walls defining the bounds of the reservoir, however, as the dividing wall in the reservoir has a height shorter than exterior walls of the reservoir defining the volume of the reservoir. The reservoir can include various filters, standpipes, fittings, or other structures useful in fluid mechanics. The design eliminates restricting the height of the supply item container. It also allows flexible placement of the supply item within the machine.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the features of the invention, methods and apparatus include a recirculation system for micro-fluid applications, such as a system to circulate ink throughout an inkjet printer imaging device. The system includes containers to supply an initial or refillable amount of fluid to the system and reservoirs intermediately positioned between the supply item container and ink ejection heads.

Figure 1:
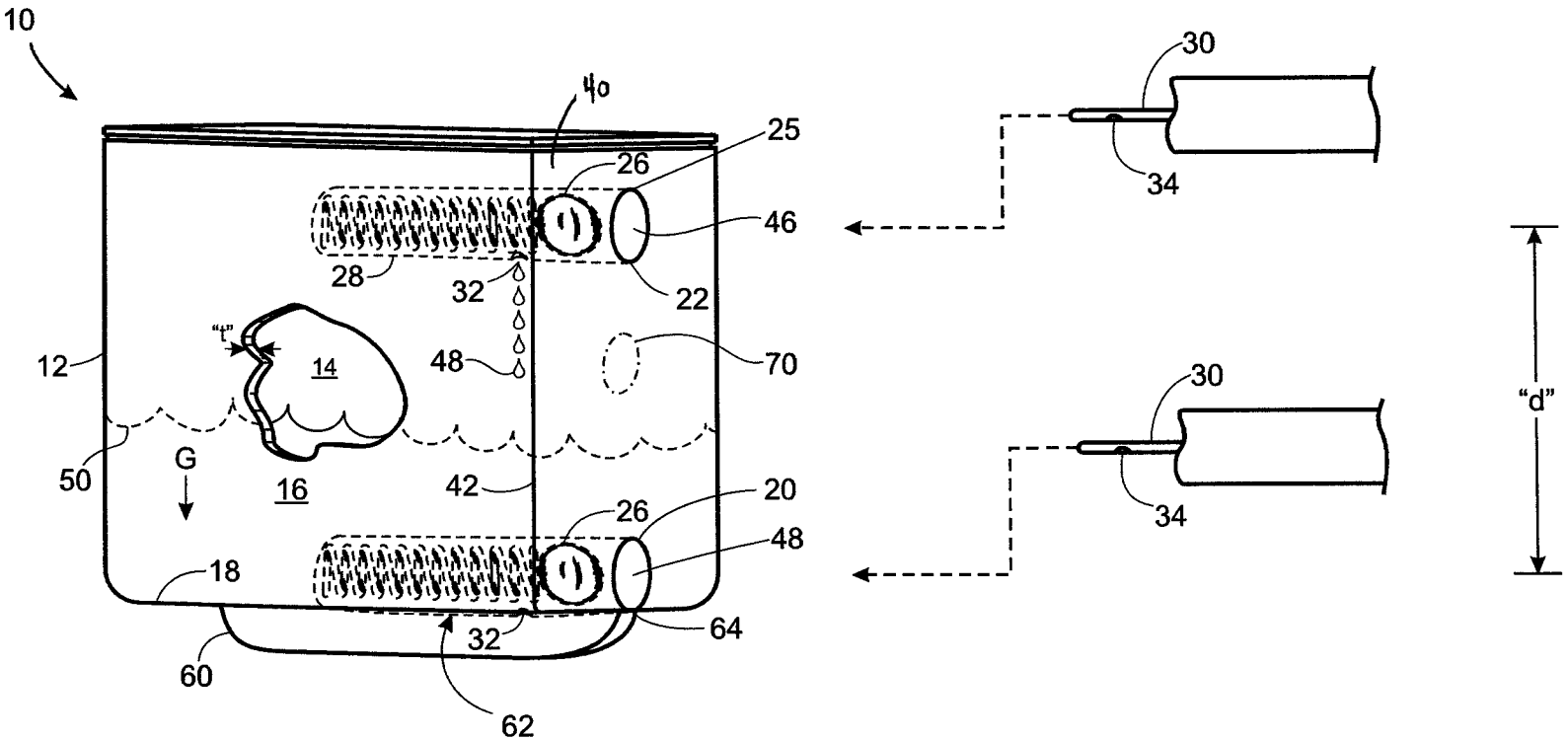
FIG. 1 is a diagrammatic view of a consumable supply item in accordance with the present invention.

With reference to FIG. 1, a supply item 10 for use in an imaging device includes a housing 12 defining an interior 14. It contains an initial or refillable supply of ink 16. The ink is any of a variety of aqueous inks, such as those based on dye or pigmented formulations. It also typifies varieties of color, such as cyan, magenta, yellow, black, etc. It is used in diverse applications such as inkjet printing, medical imaging, forming circuit traces, etc.

During use, the volume of ink depletes downward toward a bottom surface 18 of the interior of the housing in a direction of gravity G. The bottom surface is generally flat or sloped. It directs fluid toward one end 25 of the housing from which the ink can be drawn toward an imaging device. The ink flows out of the housing to the imaging device by way of an exit port 20. Ink flows back into the housing from the imaging device by way of a return port 22.

The ports are any of a variety but typify cylindrical tubes 24 with internal ball 26 and spring 28. They each mate with a septum needle 30 from the imaging device. The needle inserts into the port upon the action of a user. The needle and port are pushed relative to one another to overcome the bias of the spring and the ball slides rearward. Upon sufficient insertion of the needle, openings 32, 34 in the port and needle are communicated and a fluidic channel opens between the interior 14 of the housing and the needle. Fluid then exits port 20 through the needle and returns to port 22, as the case may be. Seals, rings, bezels, washers, and septums, or the like, may find utility in the design to prevent leakage. Other fluid communication channels are also within the scope of the design as are alternative plugging structures for closing the ports and retaining fluid in the housing interior when not in use.

The housing is any of a variety of containers for holding ink. Its material can embody glass, plastic, metal, etc. It can be recyclable or not. It can encompass simplicity or complexity. Techniques for producing the housing are variable as well. Blow molding, injection molding, etc. are envisioned. Welding, heat-staking, gluing, tooling, etc. are also envisioned. Selecting materials for the housing and designing the production, in addition to ascertaining conditions for shipping, storing, using, etc. the housing, includes focusing on further criteria, such as costs, ease of implementation, durability, leakage, and a host of other items.

The shape of the housing is varied. In one embodiment, the shape is dictated by an amount of fluid to be retained and good engineering practices, such as contemplation of the larger imaging context in which the housing is used. In the design given, the housing is generally cylindrical or rectangular and sits vertically upright. It holds of volume of ink on the order of about 450 ml in a container defining a capacity of about 500 ml. It has a height of about 120 mm. In smaller designs having the same height, the ink volume is about 150 ml in a capacity of about 180-190 ml. The walls of the housing have a thickness "t" and are generally the same about an entirety of the housing. They are sufficiently thick to maintain the shape of the housing throughout a lifetime of usage. They are rigid to preventing bowing, tilting and the like. They are not defined, however, that material is excessively wasted. The thickness ranges from about 1.5 to about 2.0 mm. The walls may be also formed as a unitary structure in a single instance of manufacturing or as pieces fitted together from individual parts. The latter envisions a modular construction.

In one embodiment, a front piece 40 supports both the ink exit and return ports 20, 22 in vertical alignment. It holds them one above the other at a distance "d" that matches the distance of separation between the needles of the imaging device. The ports insert through the front piece in an instance of manufacturing separate from the construction of the walls of the housing. The front piece connects to the walls after construction of the walls, such as by welding at joints 42. The modularity enables variability in the volume of the housing for differing imaging applications, but without complicating manufacturing. Namely, a front piece 40 can be consistently sized and shaped to match the fluid fittings of the imaging device. At the same time, the front piece can fit on either a large or small container simply by attaching it to the walls of the housing. As its construction is more complex than the construction of the housing walls, the complex manufacturing is separated from simple manufacturing. (E.g., construction of the front piece includes forming the front piece, providing openings 46, 48 for the ports and attaching/inserting the tube, ball, spring, etc. versus simply molding the walls.) This enables the size of the housing walls to vary as demand dictates, but overall manufacturing only changes by the amount necessary to make the walls different sizes. The construction of the front piece, ports and tooling remains the same from one product offering to the next. This saves costs while allowing many differently sized products.

In either the modular or integral design, the housing arranges its ink exit and return ports one above the other. The return port is higher than the exit port and has a larger cross-sectional opening through the thickness of the housing than does the opening of the exit port. It one embodiment, the size of the return port is about 1.2 times as large as the size of the exit port, or greater. In another, it is 2.0 times as large, or greater. The actual diameter of the openings is about 1.0-4.0 mm for the exit port and about 2.0-8.0 mm for the return port.

The disparity in sizes and location of the ports facilitates certain advantages. One, the larger return port means that the volume of ink returned back into the housing from the imaging device will be slowed in velocity. As ink falls 48 from the return port down to a current fill level 50 of the fluid in the container, the slowed velocity minimizes ink frothiness or bubble activity in the container. Fewer bubbles also translate into more consistent ink flow from the exit port back into the imaging device. Fewer bubbles aids too in the accuracy of ink level detection. In those designs incorporating level detectors, air does not push tops of bubbles higher than the current fill level 50. Two, the larger return port assists manufacturers in the assembly of the supply item. With one port larger than the other port, humans or assembly machines are able to visibly and easily discern parts for selection during construction of the device. Once constructed, the difference in size also helps to properly orient the front piece on the housing walls with the larger port on top. Color coding of the different ports can be additionally used to facilitate part selection and orientation. Three, the time to fill ink in the container is shortened when using a large port. It is estimated that filling with the return port will save about one third of the time over filling without it. Four, drawing ink from the housing and returning it through the exit port will keep pigmented ink stirred, thereby overcoming settling problems. Its delivery to the imaging device is kept consistent in composition.

In one embodiment, the two ports along the housing are also separated from one another vertically as far as feasibly practicable. A maximum vertical distance between them enables a large-as-possible space in the housing for at least two benefits. First, purging an imaging device may require emptying existing ink in fluid lines and the printhead. Space in the container accommodates adding extra ink back into the supply item. Also, air can be suctioned from the imaging device back into the supply item and its space accommodates this too. Second, keeping the ports separated by a great distance forces the position of the return port 22 to be as high as possible on the container. In turn, the return port is maintained above the current fill level 50. This avoids complex valves in the port.

To prevent stranding unused ink in the container during use, fluid is prevented from occupying space beneath the bottom surface 18 of the interior. However, the housing further includes a section 60 below the bottom surface to retain a portion 62 of the ink exit port 20 so that a bottom 64 of the opening 48 of the ink exit port is substantially horizontally aligned with the bottom surface 18 of the interior. In this way, a substantial entirety of the volume of ink in the interior is allowed to pass to the imaging device without stranding the volume of ink beneath the opening of the ink exit port if it were otherwise positioned above the bottom surface 18.

Figures 4A, 4B, 4C, 4D:
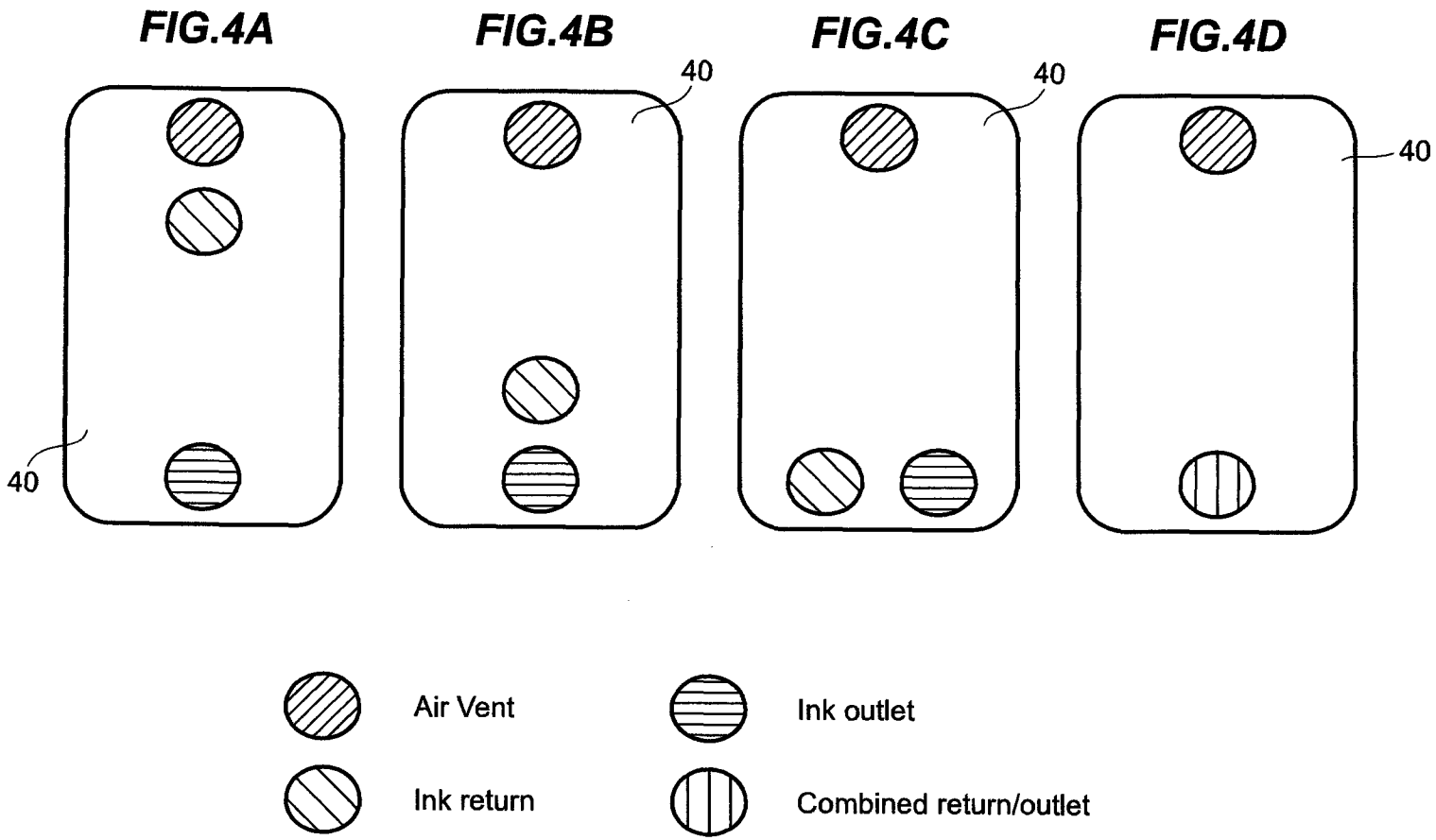
FIGS. 4A-4D are diagrammatic views of representative port locations on a supply item housing.

The housing also requires an air vent to prevent pressure variations during fluid exit and return that from either overfilling the supply item or pressurizing it with air. In one embodiment, an air venting port can be a port 70 similar to the ink exit and return ports that mates with a needle connected to an air source (atmosphere, recycled air, fan, etc.) by way of the imaging device. When the needle is communicated to the housing interior, the housing is vented. The placement of the air vent port could be linearly arranged on the front piece in a manner consistent with modular assembly of the supply item. In FIGS. 4A-4C, alternate locations of the air vent port are illustrated on the housing relative to the ink exit and return ports. In FIG. 4D, a single air venting port exists at a top of the housing and a single combined port exists near a bottom of the housing for both ink exit and return. This, however, requires a two way valve and controller in the imaging device which complicates fluid control. In still another embodiment, the vent could be a traditional tortuous or serpentine path in a thickness of the housing. Skilled artisans will observe that the position of the return port in any of these designs can also assume a placement location closer to the exit port instead of residing away at a maximum vertical distance. Closer exit and return ports may assist in better stirring of pigmented ink or provide other benefits.

Figure 2:
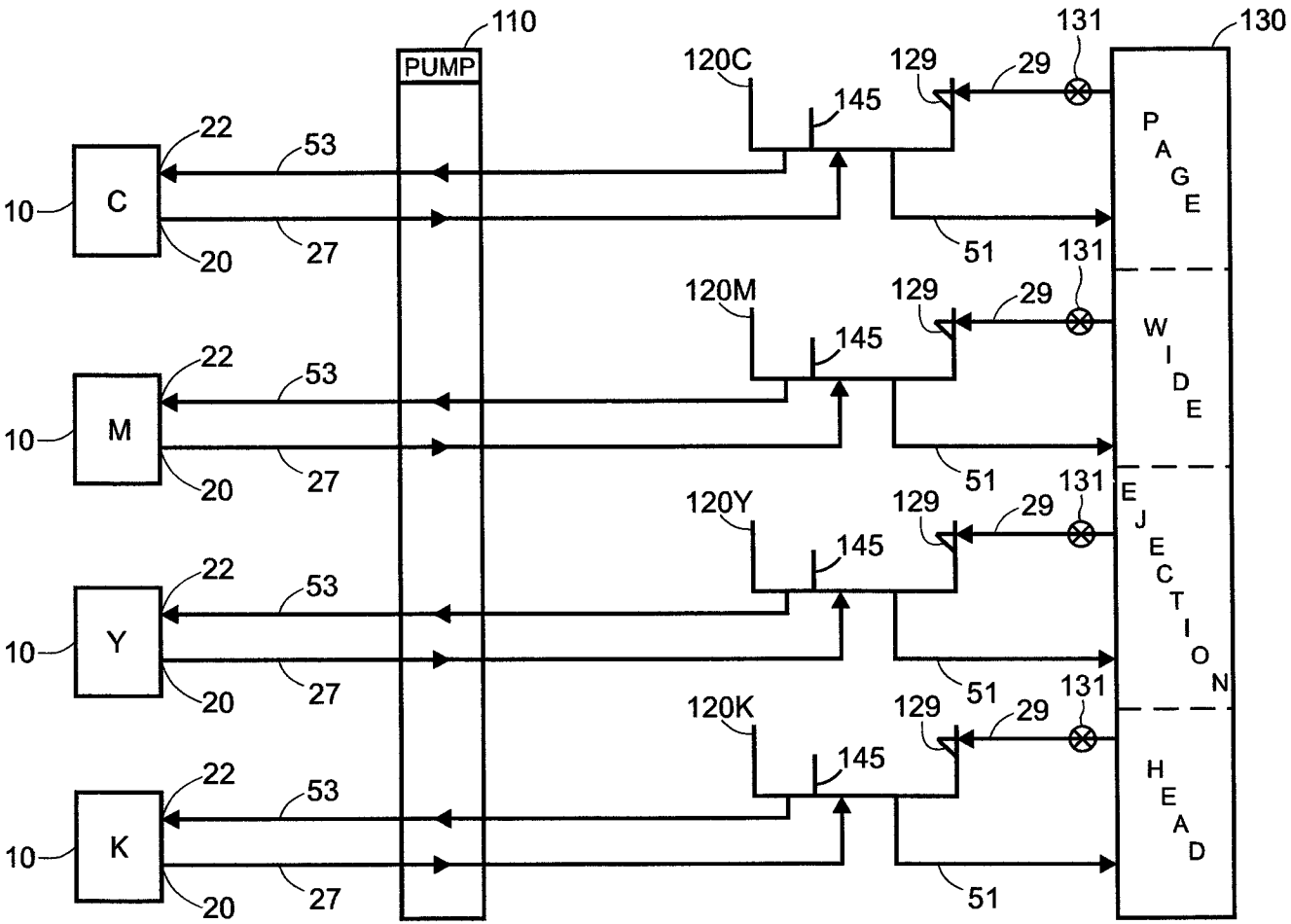
FIG. 2 is a diagrammatic view of a fluid circulation system in an imaging device, including consumable supply item and fluid reservoir.
Figure 3A:
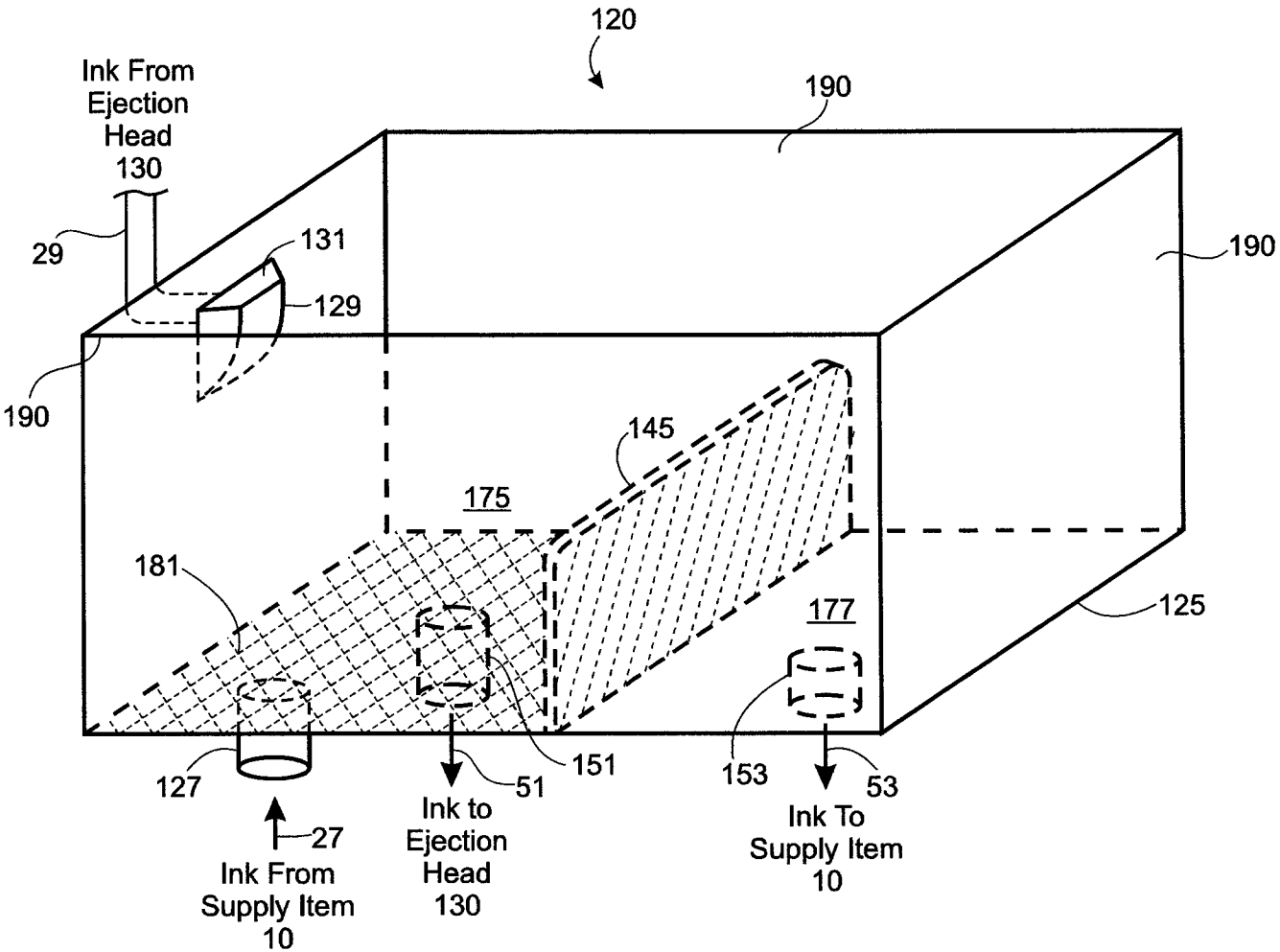
FIGS. 3A and 3B are views of a fluid reservoir and deployment in an imaging device.
Figure 3B:
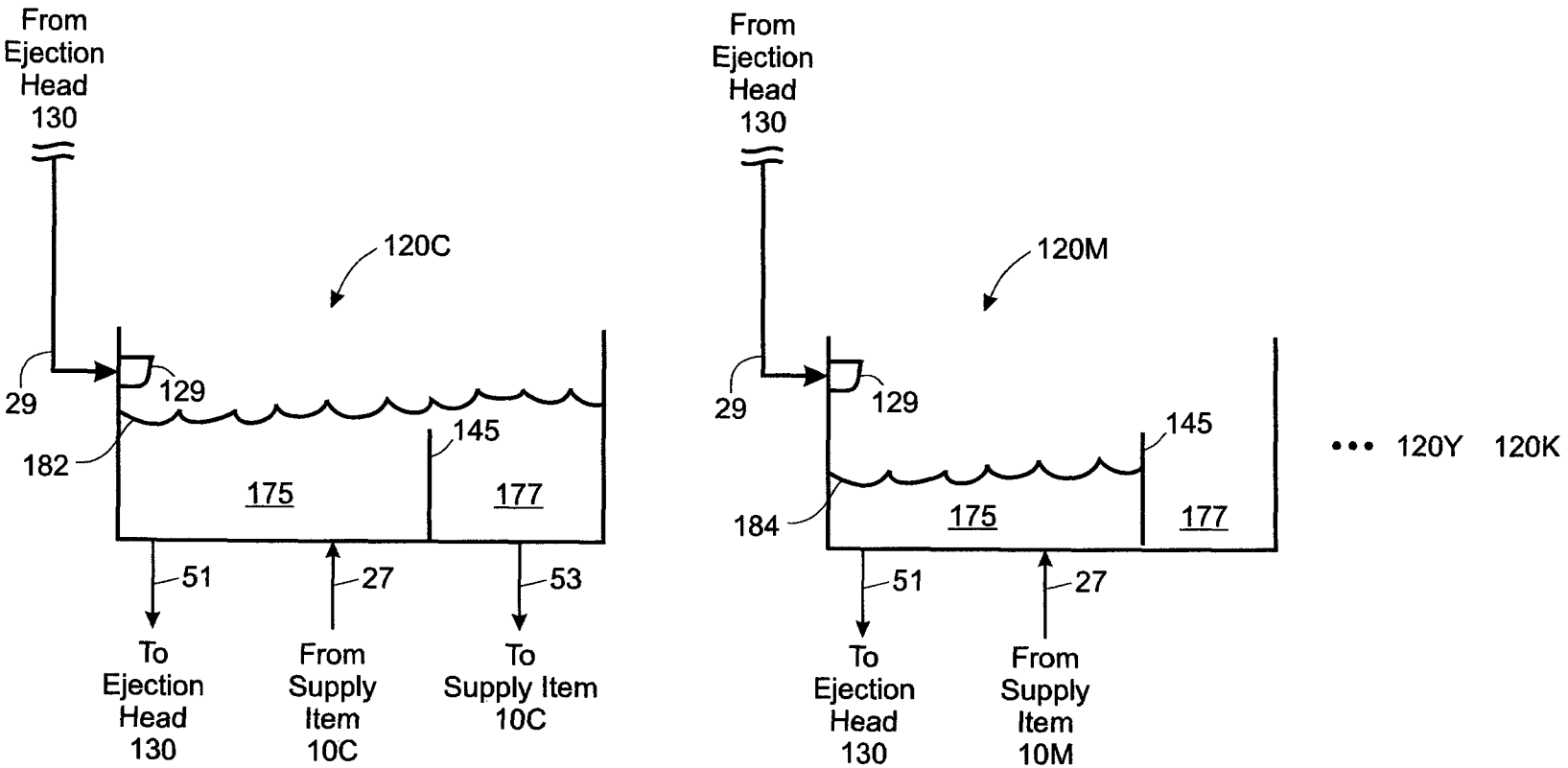

In an imaging device, the supply item interfaces with a fluid (re)circulation system. As seen in FIGS. 2-3B, the fluid (re) circulation system 100 includes a multi-channel pump 110 and a plurality of reservoirs 120. The pump and reservoirs (re)circulate fluid from sources of differently colored supply items 10 to an ejection head 130 for imaging operations. The supply items are available in a variety of colors, such as cyan (C), magenta (M), yellow (Y), and black (K). Similarly, the reservoirs 120 and individual nozzles (not shown) of the ejection head are dedicated to one of the colors. They are also independent of one another and exist in discrete fluid circulation channels.

During use, the pump forces fluid into the reservoirs 120 on fluid lines in the direction of the arrows. The pump activates to fill the reservoir upon meeting certain criteria. Examples include initiating fill upon reaching a predetermined low limit within the reservoir or supply item, ejecting a predetermined number of fluid drops from the ejection head, exceeding a predetermined time limit, commanding the evacuation of fluid from the ejection head to deprime it, or by way of any other means. The fill of the reservoir occurs from the supply item by way of its fluid exit port 22. It travels in a fluid line 27 to a bottomside 125 of the reservoir. It enters the reservoir at inlet port 127. From the ejection head, fill of the reservoir occurs along fluid line 29. Fluid enters at a second inlet in the form of a standpipe 129. The standpipe has an entrance 131 elevated above a height of a dividing wall 145. Its operation is described below. Fluid leaves the reservoir at outlet ports 151 and 153. It travels in fluid lines 51 and 53 back to the ejection head and the supply item(s), respectively. (Alternatively, the entry and exit of fluid from the reservoir can occur by way of fluid channels to other locations around the reservoir. A lid may be also placed as a cover on the reservoir. The inlet from the ejection head can reside in the lid. Ink level sensing in the reservoir is available too as needed.)

Also, the dividing wall 145 defines separate sections of the reservoir having separate uses. In the larger section, the wall defines a backpressure region 175. In the smaller section, the wall defines an overflow region 177. As their names imply, the former serves as the backpressure control mechanism for the imaging device. The latter serves as a storage section for fluid overflowed in the reservoir awaiting transport back to the supply container. (Alternatively, the reservoir may avoid the dividing wall and use a simple opening in the exterior walls to flow overflowed fluid back to the supply item.)

During use (FIG. 3B), ink flows into the reservoir 120 C from the supply item, where it fills the backpressure region 175. Eventually, fluid rises higher 182 than the height of the dividing wall and spills over into the overflow region. The operation is similar to a dam. Once in the overflow region, the spilled-over fluid can return to the ink supply on demand. At the same time, fluid 184 in reservoir 120 M has yet to fill to a height sufficient to overflow the dividing wall 145. Its overflow region 177 remains empty, as shown, or at a height lower than the height of the dividing wall. Simultaneously, or at separate times, fluid leaves the reservoir and fills the ejection head 130.

As skilled artisans will note, four fluid channels are caused to operate upon the action of a single pump 110. The fluid in respective reservoirs 120 can sit at various heights. The less full reservoirs can fill as the pump operates, while full reservoirs can simultaneously return fluid back to their supply containers. The design eliminates concerns of overfilling since once the overflow level is reached, all the additional fluid provided to the reservoir is returned to the supply item with no need to independently control each channel. Fluid also does not spill from the exterior walls 190 defining the bounds of the reservoir as the dividing wall in the reservoir has a height sufficiently shorter than a height of the exterior walls. The reservoir also can include filters 181, fittings, septums, seals, or other structures useful in fluid mechanics. Additionally, fluid line 29 may optionally include another pump or check valve 131 to assist in returning fluid from the ejection head to the reservoir. This valve may be used to create a vacuum to pull fluid into the ejection head for priming.

Representative sizes of the regions include 16-22 cc's for the backpressure and 2-8 cc's for the overflow. The size of the volume of the overflow region also can be optimized to allow for various operations of the printer. For a system level deprime, the capacity of the overflow region is made large or small to accommodate the volume of fluid that exists in the fluid lines of the imaging device so all the ink can be pulled from the ejection head and stored in the reservoir. The rate of return from the overflow region back to the supply item can be also increased above that of the rate of fill the reservoir to ensure the overflow region stays empty. Once the overflow has been evacuated of ink, air will be pulled back into the supply item through the vent in the reservoir which eliminates the risk of the overflow section from being under vaccuum.

Relatively apparent advantages of the many embodiments include, but are not limited to: (1) delivering essentially all the fluid in a container to an imaging device; (2) delivering the fluid in a manner that promotes uniform pigment concentration of ink over the lifetime of the container; (3) eliminating height restrictions of the supply item container; (4) allowing flexible placement of the supply item within the imaging device; (5) avoiding wasteful ink practices during priming operations of the ejection head; (6) precisely controlling backpressure in an imaging device; (7) operating and maintaining but a single pump for the entirety of fluid channels within the imaging device; and (8) avoiding complexity, such as eliminating or reducing the need for intricate control systems, clutches, feedback sensors, etc. for pumping systems, mechanical stir bars for supply item containers, and floats/valves for reservoirs.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All modifications and variations are contemplated within the scope of the invention as determined by the appended claims. Relatively apparent modifications include combining one or more features of various embodiments with features of other embodiments.

The invention claimed is:

1. A consumable supply item for an imaging device to hold an initial or refillable volume of ink, comprising a housing defining an interior to retain the volume of ink and ink exit and return ports, a bottom of an opening of the ink exit port being in substantially the same horizontal plane as the bottom surface of the interior, and the ink return port having a greater size than the ink exit port.

2. The supply item of claim 1, wherein the ink return port resides above the ink exit port on the housing as the housing is oriented during use.

3. The supply item of claim 2, wherein the ink return port resides away from the ink exit port at a maximum vertical distance.

4. The supply item of claim 1, wherein the ink exit and return ports include a ball biased toward an exterior of the housing to keep shut the ports when not in use and retain the volume of ink in the interior.

5. The supply item of claim 1, wherein the housing further includes an air venting port.

6. The supply item of claim 5, wherein the air venting port and the ink exit and return ports are linearly aligned along the housing.

7. The supply item of claim 6, wherein the ink return port is a highest port said along the housing as the housing is oriented during use.

8. The supply item of claim 1, wherein the ink exit and return ports define a cross-sectional area through a thickness of the housing, said area of the ink return port being larger than said area of the ink exit port by about 1.2 times or greater.

9. The supply item of claim 1, wherein the housing defines a bottom surface in the interior beneath which the volume of ink is prevented from occupying, the housing further including a section below the bottom surface of the interior to retain a portion of the ink exit port to substantially pass an entirety of the volume of ink from the interior to the imaging device without stranding the volume of ink beneath the opening of the ink exit port.

10. A consumable supply item for an imaging device to hold an initial or refillable volume of ink, comprising a housing defining an interior to retain the volume of ink and ink exit and return ports, a bottom of an opening of the ink exit port being in substantially the same horizontal plane as the bottom surface of the interior, the ink return port having a cross-sectional area to flow fluid into the housing that is greater in size than a cross-sectional area of the ink exit port that flows fluid out of the housing to the imaging device during use, the ink return port residing above the ink exit port as oriented during use.

11. The supply item of claim 10, wherein the ink exit and return ports are linearly aligned along the housing.

12. The supply item of claim 11, wherein the housing further includes an air venting port, the air venting port and the ink exit and return ports all being linearly aligned along the housing.

13. The supply item of claim 10, wherein the cross-sectional area of the ink return port is about 1.2 times or more the size of the cross-sectional area of the ink exit port.

14. The supply item of claim 10, wherein the housing defines a bottom surface in the interior beneath which the volume of ink is prevented from occupying, the housing further including a section below the bottom surface of the interior to retain a portion of the ink exit port to substantially pass an entirety of the volume of ink from the interior to the imaging device without stranding the volume of ink beneath the opening of the ink exit port.

15. The supply item of claim 10, wherein the ink exit and return ports define openings through a thickness of the housing, the openings including a plugging structure for closing the ports when not in use.

16. The supply item of claim 10, wherein a modular front piece includes both the ink exit and return ports in vertical alignment, the modular front piece connecting to a front of the housing for the ink exit and return ports to interface with the imaging device as the housing fronts the imaging device as oriented during use.

17. A consumable supply item for an imaging device to hold an initial or refillable volume of ink, comprising a housing defining an interior to retain the volume of ink and ink exit and return ports defining openings through the housing, the ink return port having a cross-sectional area to flow fluid into the housing that is greater in size than a cross-sectional area of the ink exit port that flows fluid out of the housing to the imaging device during use, the housing oriented during use to deplete the volume of ink in a direction of gravity toward a bottom surface of the interior beneath which the volume of ink is prevented from occupying, the housing further including a section below the bottom surface of the interior to retain a portion of the ink exit port so that a bottom of the opening of the ink exit port is in substantially the same horizontal plane as the bottom surface of the interior as the housing is oriented during use to substantially pass an entirety of the volume of ink from the interior to the imaging device without stranding the volume of ink beneath the opening of the ink exit port.

18. The supply item of claim 17, wherein a modular front piece supports both the ink exit and return ports in vertical alignment, the modular front piece connecting to the housing.

19. The supply item of claim 17, wherein the housing further includes an air venting port, wherein the air venting port and the ink exit and return ports are all linearly aligned along the housing.

20. The supply item of claim 17, wherein the cross-sectional area of the ink return port is about 2.0 times or more the size of the cross-sectional area of the ink exit port.

* * * * *